US005225807A

United States Patent [19]

Zhou et al.

[11] Patent Number: 5,225,807

[45] Date of Patent: Jul. 6, 1993

[54] METHOD AND APPARATUS FOR SENSITIZING AND DESENSITIZING TARGETS FOR ELECTRONIC ARTICLE SURVEILLANCE SYSTEMS

[75] Inventors: Peter Y. Zhou, Ronkonkoma; Dexing Pang, Levittown, both of N.Y.

[73] Assignee: Knogo Corporation, Hauppauge, N.Y.

[21] Appl. No.: 760,506

[22] Filed: Sep. 16, 1991

[51] Int. Cl.[5] ..... G08B 13/24; H01F 7/20

[52] U.S. Cl. ..... 340/551; 335/284; 340/572

[58] Field of Search ..... 340/551, 572; 335/284; 310/152, 154, 156

[56] References Cited

U.S. PATENT DOCUMENTS

| | | | |
|---|---|---|---|
| 3,423,674 | 1/1969 | Goldsmith et al. | 324/45 |
| 3,665,449 | 5/1972 | Elder et al. | 340/572 |
| 3,765,007 | 10/1973 | Elder et al. | 340/572 |
| 3,780,521 | 12/1973 | Kurita et al. | 368/163 |
| 4,499,444 | 2/1985 | Heltemes et al. | 335/284 |
| 4,623,877 | 11/1986 | Buckens | 340/572 |
| 4,684,930 | 8/1987 | Minasy et al. | 340/572 X |
| 4,703,210 | 10/1987 | Abukawa et al. | 310/154 |
| 4,709,179 | 11/1987 | Banon et al. | 310/156 |
| 4,752,758 | 6/1988 | Heltemes | 335/284 |
| 4,992,767 | 2/1991 | Hozumi et al. | 335/284 |

FOREIGN PATENT DOCUMENTS

A0237950 9/1987 European Pat. Off. .

*Primary Examiner*—Jin F. Ng
*Assistant Examiner*—Thomas J. Mullen, Jr.
*Attorney, Agent, or Firm*—Fitzpatrick, Cella, Harper & Scinto

[57] ABSTRACT

Magnetically desensitized targets or sensor elements on protected articles are resensitized by means of rotating permanent magnets which are moved relative to the magnetized target desensitizer elements such that the elements become subjected to reversing magnetic fields of gradually decreasing intensity.

20 Claims, 4 Drawing Sheets

A
7
3
N
S

Magnetization
Applied Magnetic Field

A
N
S
Z

METHOD AND APPARATUS FOR SENSITIZING AND DESENSITIZING TARGETS FOR ELECTRONIC ARTICLE SURVEILLANCE SYSTEMS

BACKGROUND OF THE INVENTION

1. Field of the Invention

This invention relates to the sensitizing and desensitizing of targets used in electronic article surveillance systems and more particularly it is directed to novel arrangements for controlling the magnetization of high magnetic coercivity desensitizing elements which are spaced apart along the length of such targets.

2. Description of the Related Art

Electronic article surveillance systems of the type with which the present invention may be used are shown and described in U.S. Pat. No. 4,623,877. As shown in that patent, articles of merchandise to be protected from unauthorized taking from a protected area, such as a store or a library, have targets mounted on them and when the merchandise is taken out through an exit from the protected area, the target encounters an alternating magnetic interrogation field which is generated at the exit. The target is an elongated strip of a low coercivity magnetic material which is driven alternately into and out of magnetic saturation by the magnetic interrogation field. This causes the target to disturb the field and to produce magnetic fields which are harmonically related to the original interrogation field. These harmonics are detected and used to generate an alarm.

When a protected article of merchandise is purchased or otherwise authorized to be taken from the protected area, its target must be desensitized so that the merchandise can be taken from the protected area without generating an alarm. One way that has been found very effective is to provide the target with a plurality of spaced apart desensitizer elements or slugs of a high coercivity magnetic material. When these desensitizer elements are magnetized, they prevent the target from generating detectable responses to the interrogating magnetic field. When the desensitizer elements are demagnetized, the target is again made sensitive to the interrogating magnetic fields.

A problem arises in the sensitization of targets. The magnetic hysteresis characteristic of the desensitizer elements is such that when they are subjected to a demagnetization field sufficient to overcome their original magnetic condition, they become remagnetized in the opposite direction. It is necessary therefore to subject the target desensitizer elements to alternating magnetic fields of gradually diminishing intensity. One way of doing this is proposed in U.S. Pat. No. 3,665,449 at Column 5, lines 40–64 and No. 3,765,007 at Column 5, lines 30–56. Specifically it is there proposed to provide either an electromagnet which is subjected to alternate energization at diminishing amplitudes or to provide a series of permanent magnets of successively diminishing strength arranged in a line and passing them over a target desensitizer element.

SUMMARY OF THE INVENTION

The present invention overcomes these problems of the prior art and provides novel apparatus and methods for sensitizing targets.

According to one aspect of the invention there is provided a novel sensitizer for sensitizing electronic surveillance system targets of the type that have a plurality of spaced apart magnetizable desensitizer elements along their length. This novel sensitizer comprises a base with a motor and a carrier mounted in the base. The carrier is arranged to be driven by the motor to rotate about a given axis. At least one permanent magnet is mounted on the carrier at a location and orientation such that upon rotation of the carrier, the poles of said magnet revolve around the given axis and the magnetic field from the magnet extends out from the base. Means are also provided for positioning a target to be sensitized such that magnetized elements extending along the length thereof become successively exposed to cyclically reversing magnetic fields of successively reduced intensity.

According to another aspect of the invention there is provided a novel method of sensitizing electronic surveillance system targets of the type that have a plurality of spaced apart magnetizable elements along their length. This novel method comprises the steps of causing the poles of at least one permanent magnet to revolve around a given axis to produce, in a given region, a cyclically reversing magnetic field and causing a sensitized target to enter into and exit from the reversing magnetic field.

DETAILED DESCRIPTION OF THE PREFERRED EMBODIMENTS

Figures 1, 2, 3, 4:
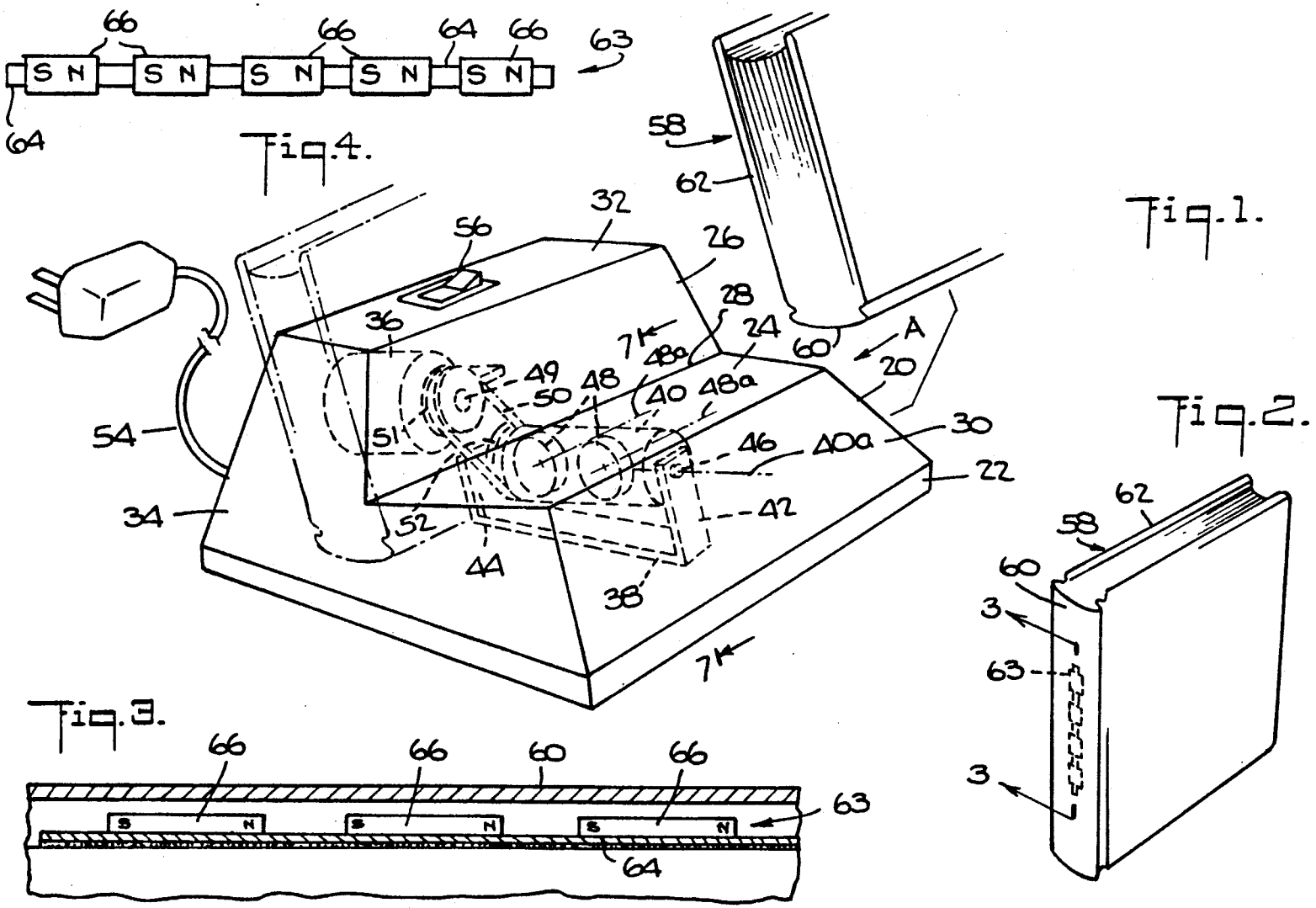
FIG. 1 is a perspective view showing a target sensitizer/desensitizer apparatus comprising one embodiment of the invention and showing a book with which the apparatus is being used.
FIG. 2 is a perspective view showing the book of FIG. 1 with a target assembly in its spine.
FIG. 3 is an enlarged view taken along line 3—3 of FIG. 2 and showing the target assembly.
FIG. 4 is a plan view of the target assembly of FIG. 3.

The target sensitizer/desensitizer of FIG. 1 includes a hollow box-like housing 20 which is mounted on a flat base 22. The housing and base are preferably of plastic or other non-magnetic material. The housing 20 is formed with a sensitizer wall 24 and a guide wall 26 which extend at right angles to each other along a horizontal line 28. The sensitizer wall 24 is nearly horizontal but slopes slightly upwardly from the line 28 to the upper edge of a front wall 30. The guide wall 26 is nearly vertical but inclines slightly rearwardly from the horizontal line 28 to the front edge of an upper horizontal wall 32. The housing 20 is closed by end walls 34 and a back wall (not shown).

Inside the housing 20, as shown in dashed outline, are mounted a drive motor 36, a mounting frame 38 and a magnet carrier 40. The magnet carrier 40 is in the form of an elongated cylinder and is mounted in the mounting frame 38 for rotation about its longitudinal axis 40*a* which extends in a direction perpendicular to the direction of the line 28 and under and parallel to the sensitizer wall 24. The mounting frame 38 is a generally U-shaped bracket with a longer front leg 42 extending up along the front wall 30 and a shorter rear leg 44 extending up parallel to but behind the guide wall 26. The front and rear legs 42 and 44 are provided with bearings 46 to support the opposite ends of the magnet carrier 40 so that the it rotates about its longitudinal axis 40*a* with its cylindrical surface parallel to and just under the slightly sloping sensitizer wall 24.

The magnet carrier 40 is of a non-magnetic material, such as plastic; and it has extending therethrough, at locations along its axis 40*a*, a pair of cylindrically shaped magnets 48. The poles of the magnets 48 extend along axes 48*a* which are perpendicular to the axis of rotation 40*a* of the magnet carrier 40, so that as the carrier rotates, alternating magnetic fields are generated at and above the upper surface of the sensitizer wall 24.

The drive motor 36 is mounted just behind the guide wall 26 with its drive shaft 49 parallel to the rotational axis 40*a* of the magnet carrier 40. An O-ring belt 50 extends around a drive pulley 51 on the motor drive shaft 49 and a groove 52 near one end of the magnet carrier 40. The motor 36 thus operates via the drive belt 50 to turn the carrier 40 about its longitudinal axis 40*a*. This in turn causes the poles of the permanent magnets 48 to revolve around the carrier axis 40*a*. As a result, the magnetic fields from the permanent magnets move with the magnets and produce, in the region just above the sensitizer wall 24, an alternating magnetic field.

The motor 36 is electrically powered through a cable 54 from an electrical outlet (not shown). Also, a switch 56 is mounted on the housing 20 and is connected in circuit with the motor 36 to control its operation.

The sensitizer/desensitizer of FIG. 1 is used to sensitize and to desensitize a target carried in the spine of a book 58. To sensitize the book's target, the switch 56 is first operated to turn on the motor 36. This causes the magnet carrier 40 to rotate about its axis 40*a* so that the permanent magnets 48 turn about the axis 40*a* to produce an alternating magnetic field in the region above the sensitizer wall 24. The book 58 is then placed with its spine 60 on the sensitizer wall 24 and its cover 62 against the guide wall 26. The book is then slid in the direction of the arrow A along the sensitizer and guide walls from one end of the housing 20 to the other. As a result, the target in the book's spine becomes exposed to the alternating magnetic field above the sensitizer wall 24. As the book is slid along the housing 20, the intensity of the alternating magnetic field on the book's target first increases and thereafter decreases in intensity. As will be explained hereinafter, the gradually decreasing alternating magnetic field effectively demagnetizes magnetic desensitizer elements on the target and thereby makes the target sensitive to alternating magnetic interrogation signals from a theft detection system.

FIG. 2 shows the book 58 with a target assembly 63 (shown in dashed outline) mounted in the book spine 60. As can be seen, the target assembly 63 is elongated and thin; and it can easily be mounted inside the spine 60. The spine holds the target assembly in a fixed orientation, hidden from view and in a manner that does not interfere with the opening and closing of the book.

As can be seen in FIGS. 3 and 4, the target assembly 63 comprises a thin continuous target strip 64 of low magnetic coercivity, highly permeable, magnetic material, such as Permalloy; although other easily saturable, low coercivity magnetic materials may also be used. The target strip 64 is easily magnetized into and out of magnetic saturation by an alternating magnetic field generated near an exit from a protected area in which the book 58 is kept. For example, the alternating magnetic interrogation field can be generated by coils located near an exit from a library. When a book carrying the target strip 64 passes through the library exit and becomes exposed to the alternating magnetic interrogation field, the strip is driven alternately into and out of magnetic saturation. This has the effect of producing a characteristic disturbance of the interrogation field in the form of pulses of predetermined spacing and frequency content. When these pulses are detected, an alarm is generated. A system for producing the above described alternating magnetic interrogation fields and for detecting the characteristic pulses produced by the target strip 64 is shown and described in U.S. Pat. No. 4,623,877.

As also shown in FIGS. 3 and 4, there are provided along the length of the target strip 64, a plurality of spaced apart desensitizer elements 66. These desensitizer elements are made of a relatively high coercivity magnetic material, for example material such as that sold under the trademark Arno-krome®. Preferably the coercivity of the target strip 64 is in the range of 0.05 oersteds and the coercivity of the desensitizer elements 66 is in the range of 65–70 oersteds. Also, by way of example, the target strip 64 may have a length of about 4 inches (10.16 cm), a width of 0.0625 inches (1.59 mm) and a thickness of 0.001 inches (0.025 mm). The desensitizer elements 66 may each have a length of 0.375 inches (9.52 mm), a width of about 0.15 inches (3.17 mm) and a thickness of about 0.002 inches (0.050 mm). The spacing between successive desensitizer elements 66 along the strip 64 is about 0.375 inches (9.52 mm).

The desensitizer elements 66 are semi-permanent magnets; and when they are magnetized, their magnetization is not affected by the alternating magnetic interrogation fields. However, when the elements 66 are magnetized, as shown by the "S" and "N" poles in FIGS. 3 and 4, their magnetic fields bias the regions of the target strip 64 between the elements into magnetic saturation. Moreover, the elements 66 bias these regions of the strip 64 so far into magnetic saturation that the alternating magnetic interrogation fields cannot drive them back out of saturation. Consequently, the target strip 64 is, in effect, magnetically broken into a group of short elements. These short elements are incapable of producing detectable disturbances in the interrogation field. Accordingly the target strip 64 is rendered insensitive to the alternating magnetic interrogation field and the book 58 may then be taken through the exit without producing an alarm.

The desensitizer elements 66 can be magnetized simply by passing the spine of the book 58 along the sensitizer/desensitizer apparatus while the magnet carrier 40 is held in a non-rotating position. As a result, the desensitizer elements 66 become subjected to a magnetic field which extends in a fixed direction along the length of the target assembly 63. Even though the field strength incident upon the desensitizer elements 66 decreases and is ultimately removed when the target is moved beyond the magnets, the high magnetic coercivity of the elements causes them to retain sufficient magnetization to bias the strip 64 into magnetic saturation.

Figures 5, 6, 9:
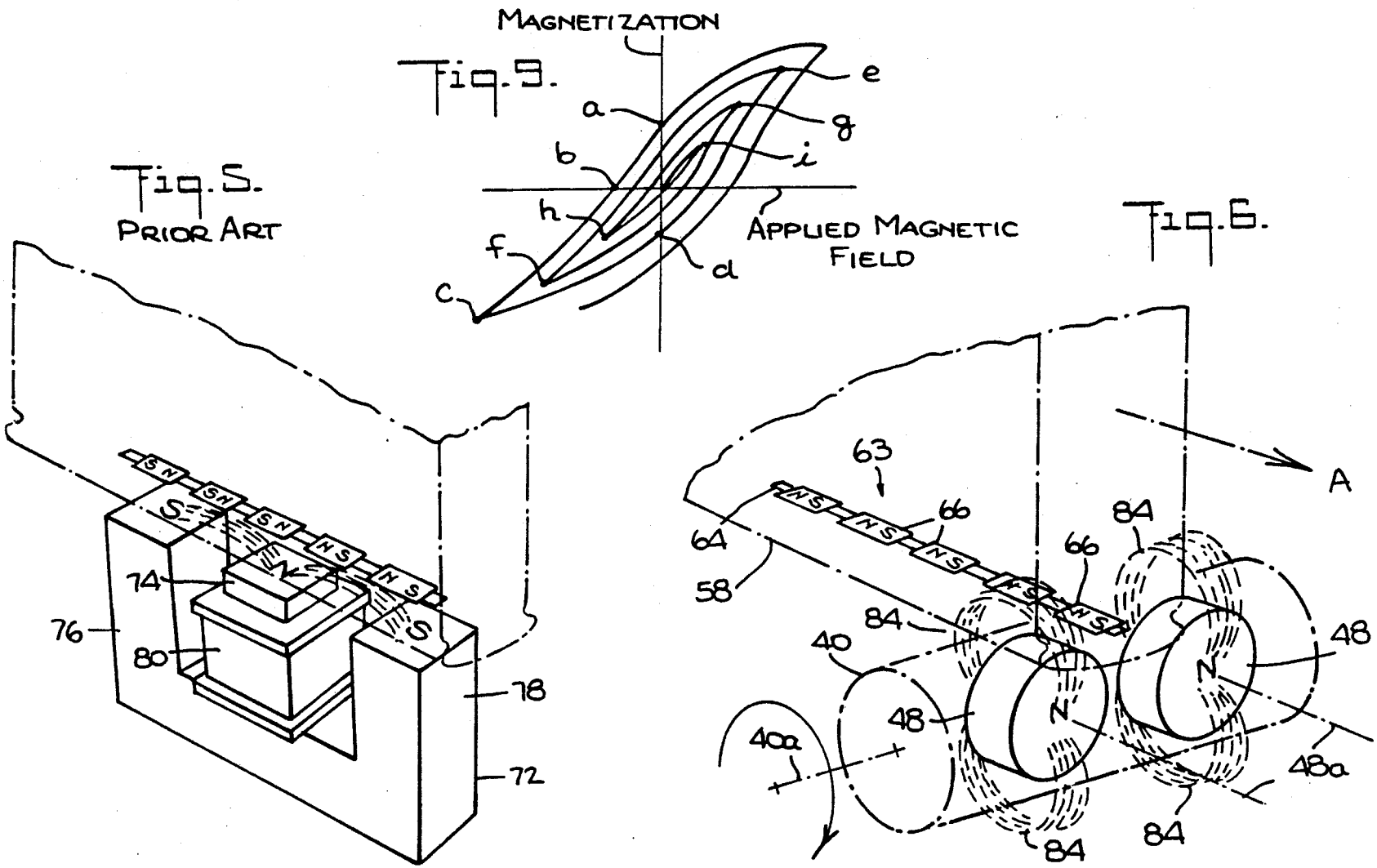
Fig. 5. Prior Art
FIG. 5 is a perspective view of a prior art target sensitizer.
FIG. 6 is a perspective view of the internal operative portion of the target sensitizer/desensitizer apparatus of FIG. 1.
FIG. 9 is a magnetic hysteresis diagram for target desensitizer elements which are positioned on target strips and which are magnetized and demagnetized according to the present invention.

FIG. 5 shows a prior art device for subjecting the control elements of elongated targets to successively reversed magnetization. As shown in FIG. 5 there is provided an electromagnet 70 which comprises an E-shaped iron core 72 having a center leg 74 and two outer legs 76 and 78 which form magnetic poles. As shown, a coil 80 is wound around the center leg 74. The coil 80 is energized with alternating current so as to produce an alternating magnetic polarity between the center leg 74 and the outer legs 76 and 78. Thus at one instant, as shown in FIG. 5, the center leg 74 is a north pole and the outer legs 76 and 78 are south poles; and at another instant the center leg is a south pole and the outer legs are north poles. When a target 63 is positioned so that it is aligned with the magnet poles as shown in FIG. 5, its control elements 66 each become subjected first to a magnetizing field in one direction and then to a magnetizing field in the opposite direction. As the target 38 is moved away from the magnetic poles, the intensity of the fields on the control elements 42 becomes less so that the control elements each become subjected to a gradually diminishing magnetic field.

Although the prior art device of FIG. 5 has no moving parts, it is bulky, heavy and expensive. Also, it requires large amounts of current which causes it to become very hot in operation and expensive to operate.

FIG. 6 shows diagrammatically how the magnet carrier 40 and the permanent magnets 48 of the present invention operate to sensitize and desensitize the target assembly 63. As shown in FIG. 6, the magnets 48 are supported by the carrier 40 with their polar axes 48*a* extending parallel to each other and perpendicular to the longitudinal axis 40*a* of the carrier. Also the permanent magnets 48 are arranged with their like poles facing in the same direction. This produces lines of magnetic flux 84 around the surface of the carrier 40. Because two permanent magnets 48 are used, the lines of magnetic flux 84 are shaped like a band which extends over a substantial portion of the length of the carrier 40. This serves to ensure that the desensitizer elements 66 will be exposed to the magnetic flux lines from the magnets 48 even though the elements may be positioned at different locations along the length of the carrier. Thus books of different thicknesses and with targets located at correspondingly different locations from either cover can be accommodated by the apparatus.

It will be noted that the magnetic fields corresponding to the magnetic flux lines 84 extend in opposite directions on opposite sides of the circumference of the carrier 40. That is, the flux lines extend in opposite directions from the North poles of the permanent magnets 48 around opposite sides of the carrier to the South poles of the magnets. Thus, as shown in FIG. 6, when the polar axes 48*a* of the permanent magnets 48 extend parallel to the target assembly 63 on the book spine 60 and the North poles of the magnets extend in the direction of the arrow A, the desensitizer elements 66 on the target assembly are subjected to magnetic fields which extend from North to South in a direction opposite to that of the arrow A. As a result, if the magnet carrier 40 remains stationary and the book 58 is moved in the direction of the arrow A, the desensitizer elements 66 become successively exposed to a magnetic field in a direction opposite to that of the arrow A and are thereby magnetized in an N-S, N-S, N-S pattern as shown.

Now if the carrier 40 is rotated about its longitudinal axis 40*a* so that the South poles of the permanent magnets 48 face in the direction of the arrow A, the direction of the magnetic flux lines and the associated magnetic fields of the permanent magnets 48 are reversed. This reversal repeats for each 180 degree rotation of the magnet carrier 40. Thus, if the carrier 40 is rotated rapidly while the book 58 is moved along in the direction of the arrow A, the desensitizer elements 66 each become exposed to magnetic fields which reverse in direction in a rapid continuous manner. If the speed of carrier rotation is high enough relative to the speed of movement of the book 58 in the direction of the arrow A, then each desensitizer element 66 will become exposed to a number of magnetization reversals. Further, as the book is moved along in the direction of the arrow A, the intensity of these reversing magnetic fields on each desensitizer element gradually decreases. As a result, the magnetization of the elements 66 is brought to zero and the target strip 64 is thereby resensitized so that it will thereafter respond to and disturb alternating magnetic interrogation fields sufficiently to actuate an alarm.

Figure 7:
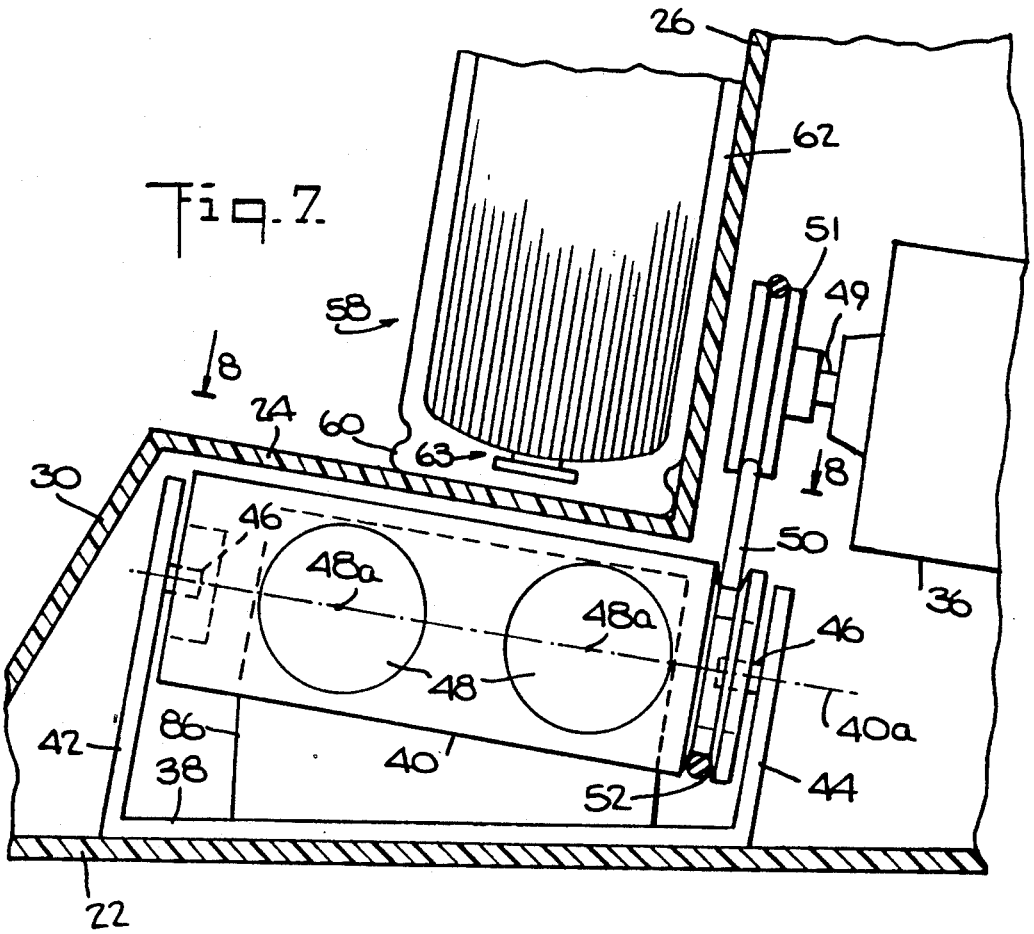
FIG. 7 is an enlarged view taken along line 7—7 of FIG. 6.
Figure 8:
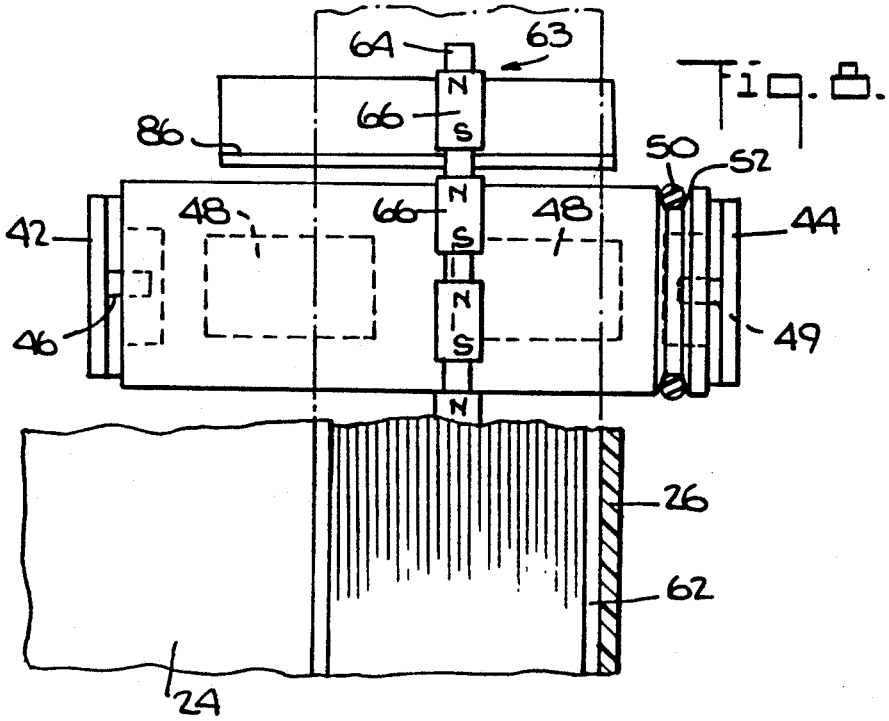
FIG. 8 is a view taken along line 8—8 of FIG. 7 and partially cut away.

FIGS. 7 and 8 show the positional relationship of the permanent magnets 48 and the sensitizer and guide walls 24 and 26 so that the magnetic fields produced by the magnets will be applied to the desensitizer elements 66 on the target strips 64. In the preferred arrangement the magnet carrier 40 is made of a polycarbonate plastic rod about 1.5 inches (3.17 cm) diameter and about 3.5 inches (8.89 cm) in length. The permanent magnets 48 are cylindrical nickel ferrite magnets which preferably have a magnetization at their circular pole faces of 2500 gauss or more. The permanent magnets in the illustrative example have a diameter of 1 inch (0.54 cm) and a length of 0.65 inches (1.59 cm). The axes 48*a* of the magnets are spaced apart from each other by 1.5 inches (3.81 cm) and are spaced from the ends of the carrier 40 by 1 inch (2.54 cm). The drive motor 36 is preferably driven so as to turn the carrier at a speed of about 2000 revolutions per minute.

It should be understood that the dimensional and other specifications given herein are not critical; and other dimensions and specifications may be used depending on the particular application. For example, if the device is to be used to sensitize or desensitize target assemblies on articles other than books, the size of the magnet carrier and the permanent magnets may be different. Also, more or less than two permanent magnets may be used; and the speed of their rotation may be different from that of the illustrated embodiment.

In order to ensure that the magnet carrier 40 always stops at a position such that the polar axes 48*a* of the permanent magnets 48 are parallel to the sensitizer wall 24, a magnetic brake may be provided in the form of an iron bracket 86 which extends from the base 22 to a position adjacent the magnet carrier 40. The iron bracket 86 magnetically interacts with the permanent magnets 48 in the carrier 40 by providing a low magnetic reluctance path which attracts either the South poles or the North poles of the magnets 48 and holds them in place so that the polar axes 48*a* are always parallel to the sensitizer wall 24 whenever the magnet carrier 40 is not rotating. When the magnet carrier 40 is held in this position, the permanent magnets 48 are properly positioned to magnetize the desensitizer elements 66 and desensitize their target when the target assembly is moved along the sensitizer surface 24.

FIG. 9 shows the effect of the alternating magnetic fields on the desensitizer elements 66. The horizontal axis of the diagram of FIG. 9 represents the applied magnetic field from the permanent magnets 48 to which the elements 66 are exposed as they are moved along in the direction of the arrow A (FIG. 6). The vertical axis of the diagram represents the magnetization of the desensitizer elements that results from their exposure to the magnetic fields of the magnets 48.

When the desensitizer elements 66 are magnetized so that they are effective in rendering a target strip incapable of responding to magnetic interrogation fields to produce an alarm, the magnetization of the desensitizer elements is as shown at (a) in FIG. 9. That is, there is no applied magnetic field (i.e. the value along the horizontal axis is zero); but the desensitizer element, because of its substantial magnetic coercivity, retains a substantial amount of magnetization. If a negative demagnetizing field is applied to reduce the magnetization to zero (point (b) in FIG. 9) and then removed, the magnetization will simply return to point (a). On the other hand, if the negative demagnetizing field is increased to bring the element to a point of negative magnetic saturation (point (c) in FIG. 9) and then removed, the element will become permanently magnetized in a negative direction (point (d) in FIG. 9). In order to bring the desensitizer element 66 to a point of zero magnetization with no applied magnetic field it is necessary to subject the element to magnetic field reversals of sufficient strength to nearly resaturate the element on each reversal and to reduce to strength of the applied magnetic field slightly on each reversal, i.e. to points (e), (f), (g), (h), (i), etc., so that the magnetization of the element follows a spiral-like pattern as shown in FIG. 9. By subjecting the element to a continuously reversing magnetic field and then decreasing the amplitude of the field as applied to the element as by moving the element away from the source of the field, the effect of FIG. 9 can be realized; and in this manner the element can be brought to zero magnetization.

Figure 10:
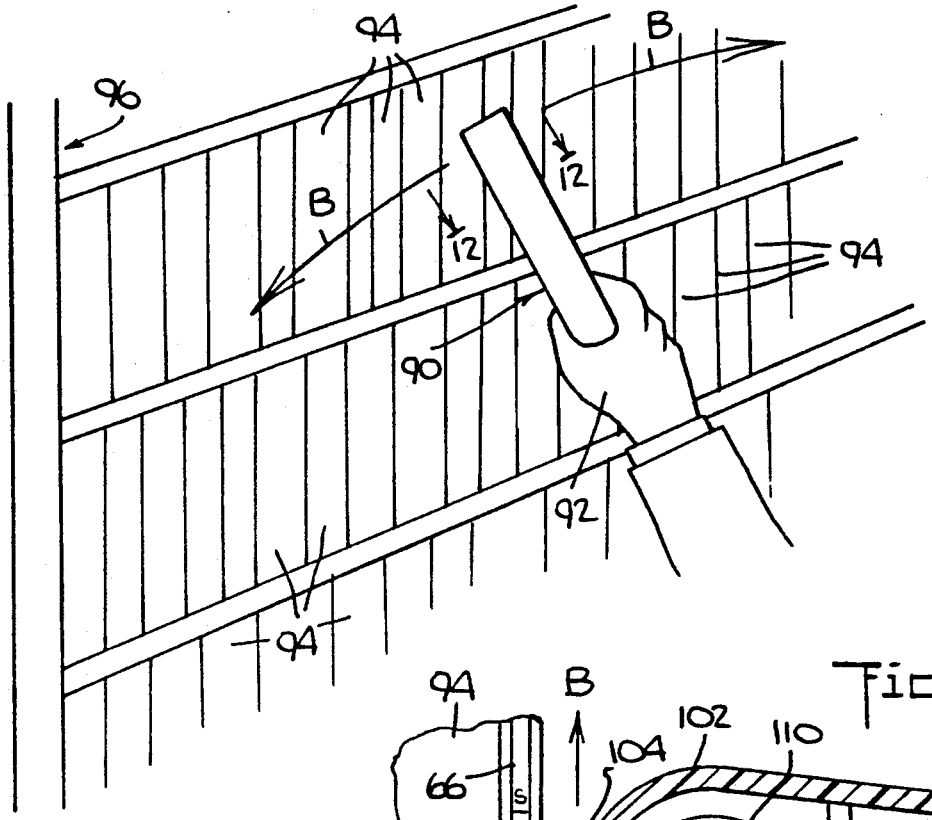
FIG. 10 is a perspective view of a second embodiment of the present invention being used to sensitize targets in books on bookshelves.
Figure 12:
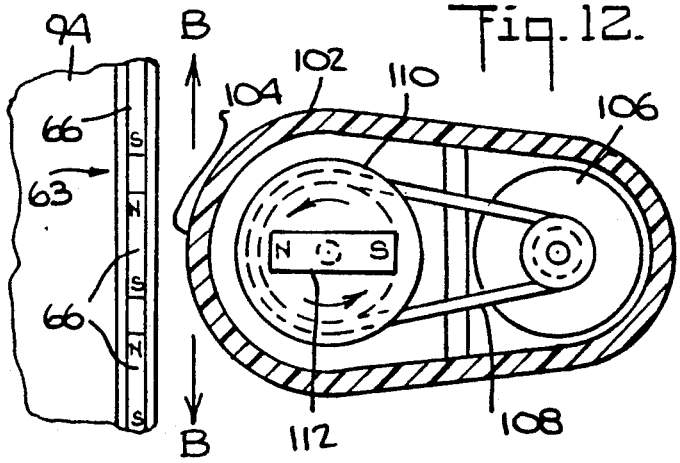
FIG. 12 is an enlarged view taken along line 12—12 of FIG. 10.
Figure 11:
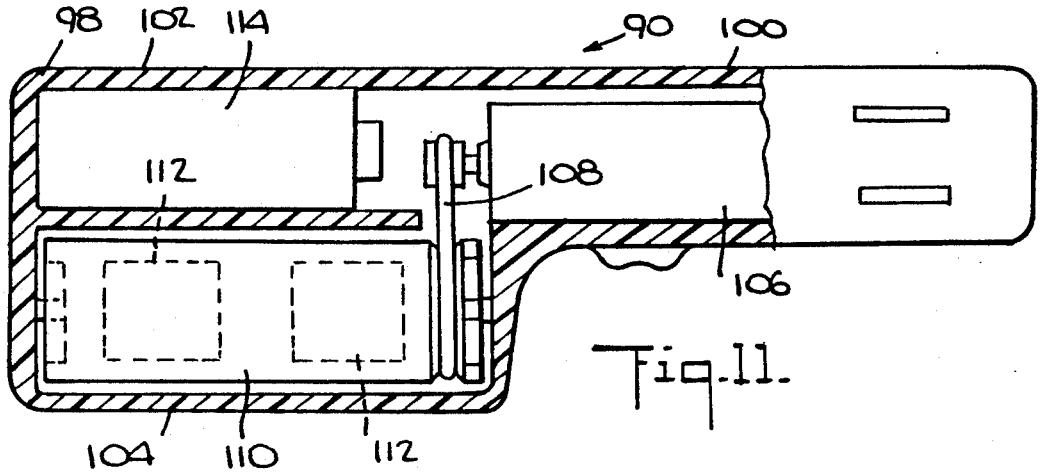
FIG. 11 is an elevational section view of the embodiment of FIG. 10.

FIGS. 10–12 show another embodiment of the invention which is portable and may be used for sensitizing target assemblies in books which are stacked in a bookshelf. As shown in FIG. 10, a sensitizer device 90 according to the invention is held in a hand 92 and is moved along a path B past the spines of books 94 in a bookcase 96. As shown in FIG. 11, the sensitizer device 90 includes a hollow plastic housing 98 with a handle portion 100 shaped to be gripped in the hand and a hollow applicator portion 102 extending out from the handle portion. The applicator portion 102 includes a sensitizer surface 104 which can be positioned against the spines of the books 94 in the bookcase. A battery powered electric motor 106 is contained in the handle portion 100; and the motor drive shaft is connected by a belt 108 to a magnet carrier 110 mounted for rotation inside the applicator portion 102 adjacent the sensitizer surface 104.

As shown in FIG. 12, permanent magnets 112 are mounted in the carrier 110 in a manner similar to that of the preceding embodiment. A battery 114 is positioned in the applicator portion 102 adjacent the magnet carrier 110. A switch 116 is arranged on the handle portion 100 and is connected between the battery 114 and the motor 106 so that operation of the motor can be controlled.

As shown in FIG. 12, the motor 106 drives the magnet carrier 110 via the belt 108 so that the poles of the permanent magnets 112 revolve around the rotational axis of the carrier and produce alternating magnetic fields in the vicinity of the sensitizer surface 104. As a result, when the sensitizer surface 104 is moved along the spines of the books 94, the desensitizer elements 66 on the book target assemblies 63 become demagnetized in the same manner as described above in connection with the preceding embodiment. The sensitizer surface 104 of this embodiment serves essentially the same purpose as the sensitizer wall 24 of the first embodiment in that each constitutes means for positioning a target to be sensitized such that magnetized elements extending along the length of the target become successively exposed to cyclically reversing magnetic fields.

It will be appreciated that with the portable device shown in FIGS. 10–12, one can easily scan the books in a library shelf to make sure that they are all resensitized, and therefore protected against possible theft.

It is also possible the use the device of FIGS. 10–12 to desensitize the target assembly on a book by maintaining the magnet carrier 110 in a non-rotating condition while scanning the device over a book target assembly.

We claim:

1. A sensitizer for sensitizing electronic surveillance system targets of the type that have a plurality of spaced apart magnetizable elements along their length, said sensitizer comprising a base, a motor mounted in said base, a carrier mounted in said base for rotation about a given axis and connected to be rotated by said motor, and at least one permanent magnet mounted on said carrier at a location and orientation such that upon rotation of said carrier, the poles of said magnet revolve around said given axis and the magnetic field from said magnet extends out from said base and means for positioning a target to be sensitized such that magnetized elements extending along the length thereof become successively exposed to cyclically reversing magnetic fields.

2. A sensitizer according to claim 1, wherein said means for positioning a target comprises a sensitizer wall having a surface mounted at a fixed position relative to said axis.

3. A sensitizer according to claim 1, and further including a brake for holding said carrier at a predetermined fixed rotational position about said given axis whereby said sensitizer is converted to operate as a target desensitizer.

4. A sensitizer according to claim 3, wherein said brake comprises an element located at a fixed position relative to said given axis and arranged to produce a magnetic interaction with said permanent magnet which is greatest at said predetermined fixed rotational position.

5. A sensitizer according to claim 1, wherein a plurality of magnets are arranged on said carrier with polar axes parallel to each other and perpendicular to and intersecting said given axis.

6. A sensitizer according to claim 1, wherein said carrier comprises a cylindrically shaped element of non-magnetic material mounted with its longitudinal axis extending along said given axis for rotation about said given axis and wherein said permanent magnet extends through said carrier with the polar axis of said permanent magnet intersecting and extending perpendicular to said given axis.

7. A sensitizer according to claim 6, wherein a plurality of permanent magnets extend through said carrier with their polar axes parallel to each other.

8. A sensitizer according to claim 7, wherein said permanent magnets are closely spaced to each other with their respective North poles close to each other and their South poles close to each other to produce a band of magnetic flux extending around the outer surface of said carrier.

9. A sensitizer according to claim 1, wherein said motor, carrier and magnet are mounted in a housing and wherein said housing includes a sensitizer wall for positioning an article containing a target to be sensitized, said sensitizer wall being closely spaced to a plane defined by the poles of said magnet as they revolve around said given axis.

10. A sensitizer according to claim 9, wherein said sensitizer wall extends in a flat plane.

11. A sensitizer according to claim 10, wherein said housing includes a guide wall at a substantially right angle to said sensitizer wall and intersecting said sensitizer wall along a line which extends in a direction substantially perpendicular to the direction of said given axis.

12. A sensitizer according to claim 1, wherein said means for positioning a target comprises a handle attached to said carrier.

13. A sensitizer according to claim 12, wherein said permanent magnet is oriented with its polar axis perpendicular to said given axis.

14. A sensitizer according to claim 13, wherein the polar axis of said permanent magnet intersects said given axis.

15. A sensitizer according to claim 14, wherein said carrier comprises a cylindrical element whose longitudinal axis extends along said given axis and wherein said permanent magnet is embedded in said cylindrical element.

16. A sensitizer according to claim 12, wherein said motor and said carrier are enclosed within a common housing and wherein said handle is attached to and forms part of said common housing.

17. A sensitizer according to claim 16, wherein said motor is enclosed within said handle and wherein a portion of said housing which contains said carrier extends beyond said handle.

18. A sensitizer according to claim 17, wherein said common housing supports a battery for supply of electrical power to said motor.

19. A sensitizer according to claim 1, wherein said motor and said carrier are driveably connected by a drive belt.

20. A method of sensitizing electronic surveillance system targets of the type that have a plurality of spaced apart magnetizable elements along their length, said method comprising the steps of causing the poles of at least one permanent magnet to revolve around a given axis to produce, in a given region, a cyclically reversing magnetic field and causing a desensitized target to enter into and exit from said reversing magnetic field.

* * * * *